United States Patent [19]

Küpper

[11] Patent Number: 4,506,420

[45] Date of Patent: Mar. 26, 1985

[54] WARP BEAM WINDING FRAME

[75] Inventor: Wilhelm Küpper, Wegberg, Fed. Rep. of Germany

[73] Assignee: W. Schlafhorst & Co., Moenchengladbach, Fed. Rep. of Germany

[21] Appl. No.: 448,766

[22] Filed: Dec. 10, 1982

[30] Foreign Application Priority Data

Dec. 12, 1981 [DE] Fed. Rep. of Germany ..... 3149304

[51] Int. Cl.[3] ..... D02H 5/00

[52] U.S. Cl. ..... 28/190; 28/196

[58] Field of Search ..... 28/172, 196, 197, 208, 28/190; 139/97

[56] References Cited

U.S. PATENT DOCUMENTS

| | | | |
|---|---|---|---|
| 3,489,910 | 1/1970 | Bohme et al. | 28/190 X |
| 3,853,287 | 12/1974 | Scholze et al. | 139/97 X |
| 4,318,428 | 3/1982 | Seifert | 139/97 |
| 4,409,710 | 10/1983 | Kofler | 28/196 |

*Primary Examiner*—Werner H. Schroeder
*Assistant Examiner*—Andrew M. Falik
*Attorney, Agent, or Firm*—Herbert L. Lerner; Laurence A. Greenberg

[57] ABSTRACT

Holding frame for a package beam of a heavy winding machine, including a right side frame and a left side frame. Each of the side frames is formed of a pair of flat sheet steel plates, with tension resistant and compression resistant spacer members interposed between each pair of plates. Each pair of plates is bolted together with the spacer member therebetween. First carriers formed of steel penetrate the plates at connection locations and rigidly connect the side frames to each other. A beam receiving device is disposed at least at one of the side frames. A second carrier with a tubular shape penetrates the pair of plates of the at least one side frame at connection locations and supports the beam receiving device. Detachable force transmission devices are disposed between the plates and at least one of the carriers at least at one of the connection locations.

20 Claims, 13 Drawing Figures

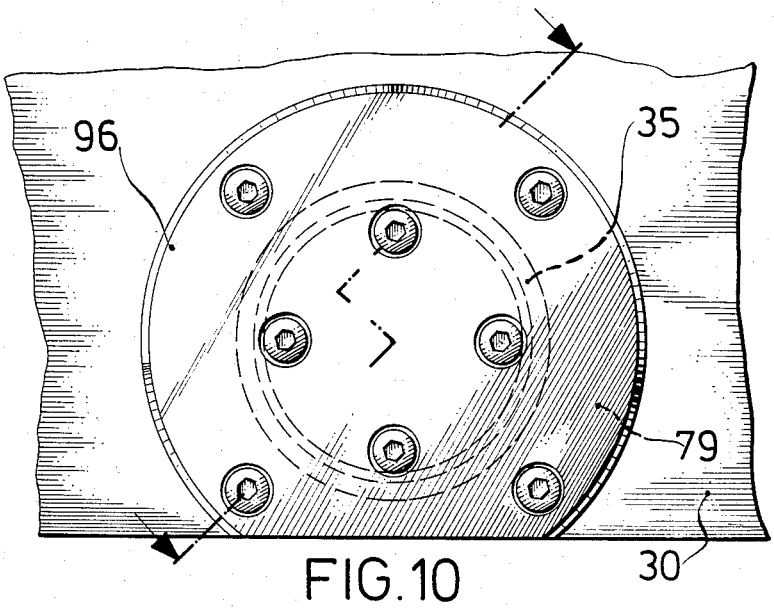
FIG. 10
FIG. 11
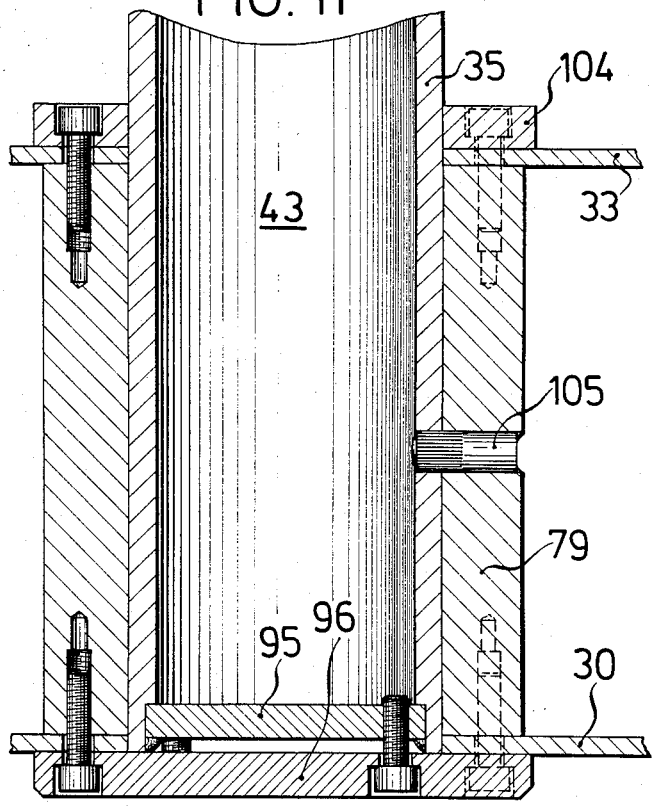

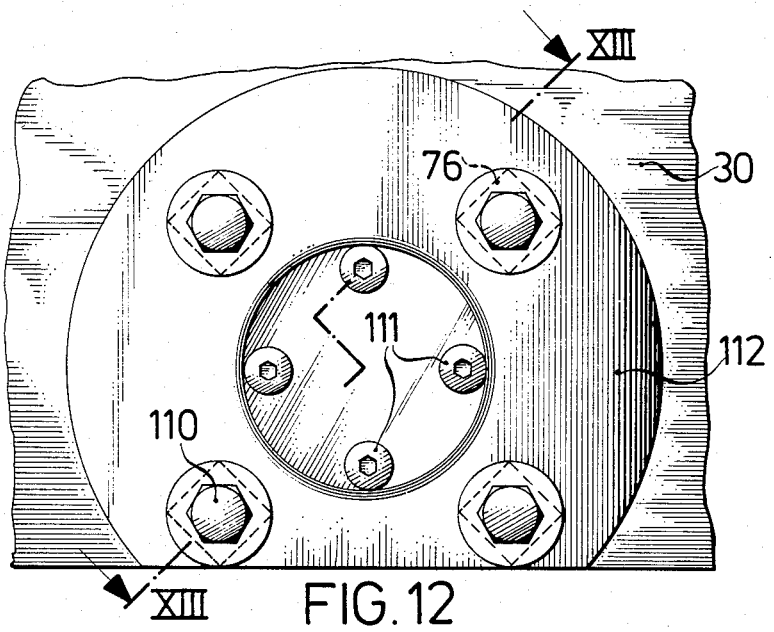
FIG. 12
FIG. 13
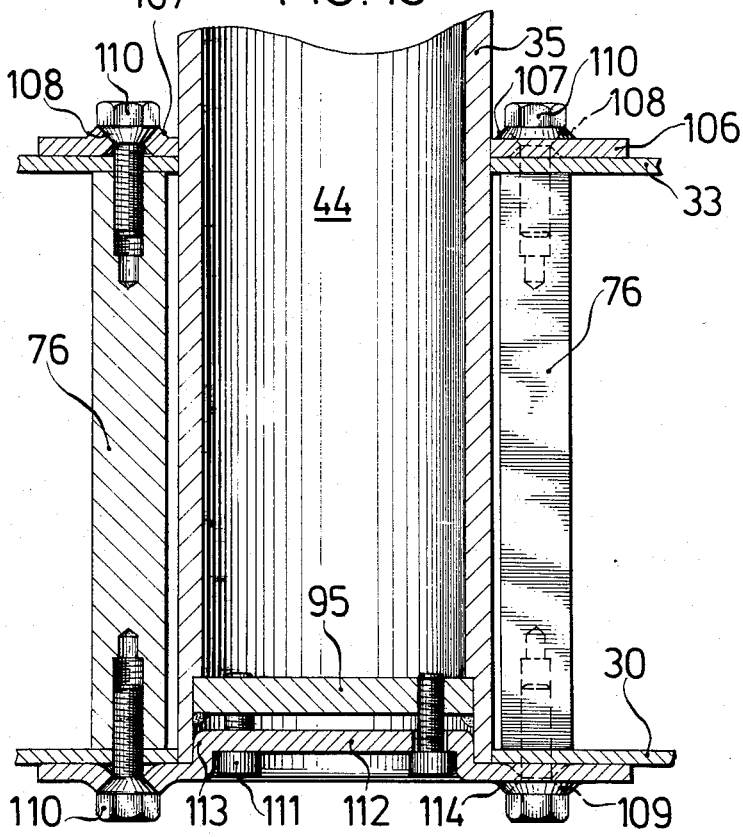

WARP BEAM WINDING FRAME

The invention relates to the field holding frame for the package or spooling frame of a heavy winding machine, such as a warping machine, warping mill or beaming machine, having a right and a left frame, which are rigidly connected to each other.

Holding frames of this type carry not only the package frame, but also other essential parts required for the operation of a heavy winding machine. Until now, the most important parts of the holding frame, such as the side frames, for example, were made as metal castings. The advantage of a metal casting is that it is possible to easily adapt the casting mold for the special conditions of the individual winding machine. Furthermore, the use of metal castings permits a light-weight construction. However, cast metal parts are quite costly and expensive to produce. New casting molds must be made, even for small differences in type. A great number of patterns must be stored, and the final treatment of the cast parts is costly. This applies to the subsequent machining operations which require a degree of precision, and also to the required surface smoothing treatment and the application of a protective coating.

It is accordingly an object of the invention to provide a holding frame for the package frame of a heavy winding machine, which overcomes the hereinafore-mentioned disadvantages of the heretofore-known devices of this general type, to considerably reduce the manufacturing costs for the holding frames of winding machines, and to simplify the bearing support apparatus.

With the foregoing and other objects in view there is provided, in accordance with the invention, a holding frame for a package or spooling beam or frame of a heavy winding machine, such as a warping machine, warping mill or beaming machine, comprising a right side frame and a left side frame, each of the side frames being formed of a pair of flat sheet steel plates. Tension resistant and compression resistant spacer members are interposed between each pair of plates. Each pair of plates is bolted together with the spacer members therebetween. First carriers formed of steel penetrate the plates at connection locations and tortionally, rigidly connect the side frames to each other. A beam receiving device is disposed at least at one of the side frames. A second carrier with a tubular shape penetrates the pair of plates of at least one side frame at connection locations and supports the beam receiving device. Detachable force transmission devices are disposed between the plates and at least one of the carriers at least at one of the connection locations.

In accordance with another feature of the invention, there is provided an intermediate frame being slideably supported on the first steel carriers. The intermediate frame is formed of a pair of flat sheet steel plates. Other tension resistant and compression resistant spacer members are interposed between the pair of plates of the intermediate frame. The plates of the intermediate frame are bolted together with the spacer members disposed therebetween. Another beam receiving device is disposed at the intermediate frame, and a third carrier with a tubular shape penetrates the plates of the intermediate frame and supports the other beam receiving device.

In accordance with a further feature of the invention, the first steel carriers are steel tubes, and the first steel carrier tubes penetrate the plates of the intermediate frame at holes formed in the plate.

In accordance with an added feature of the invention, the spacer members are bolts or are tubes or are bevelled, bent or angled steel members.

In accordance with an additional feature of the invention, the force transmitting device of the beam receiving device is constructed such that each pair of plates is formed of an outer and an inner plate, and the second or third tubular carrier has a flange integral therewith being disposed at the inner plate and has an end opposite the flange, and including a cover being disposed at the outer plate and being bolted to the end of the carrier, and a counter ring being mounted on the second or third tubular carrier and bolted to the outer plate and to the cover.

In accordance with again another feature of the invention, the force transmitting device of a steel carrier is constructed in such a way that each pair of plates is formed of an outer and an inner plate, the first steel carriers have flanges integral therewith being disposed against the inner plates and being bolted to the inner plates and bolted to at least one of the spacer members being disposed between the plates, and the first steel carriers have ends opposite the flanges, and including covers being disposed at the outer plates and being bolted to the ends of the carriers, to the outer plates and to the spacer members.

In accordance with again a further feature of the invention, the flanges are pressure rings being mounted on the first steel carriers for transmitting radial forces to the first steel carriers when bolted on.

In accordance with again an added feature of the invention, the flanges and/or covers have fastening locations, and including bridge-like raised positions disposed at least at one of the fastening locations, the raised portions having conical and/or spherical recesses formed therein for fasteners such as screws or nuts with conical or spherical contact surfaces matching the recesses.

In accordance with again an additional feature of the invention, the intermediate frame includes a bearing at each plate thereof for at least two of the first steel carriers.

In accordance with yet another feature of the invention, there is provided a longitudinally adjustable pressure and holding device for the intermediate frame and the package beam, being disposed between the left and right side frames and the intermediate frame, at the level of the beam receiving device.

In accordance with a concomitant feature of the invention, there is provided an additional reinforcement disposed between the plates where the carrier tube penetrates the plates or at the level of the pressure and holding device.

The following advantages obtained through the use of the invention are in particular:

The price per kilogram for steel plate is lower than for cast steel.

Steel plates are easier to handle, easier to transport, and easier to store than cast metal structures. In the most simple case, the steel plates are just cut to size and then bored. This can be done on stacked plates by program-controlled boring machines. Face milling operations of the steel plates are not required. Furthermore, a special surface treatment is not necessary. When applying a protective paint, no special priming or filling work is required. No storage facility for cast models and patterns has to be prepared. Only the placement, the tolerances and the quality of the bores are to be stored in a machine program. For changes in the machine type, it is essentially only necessary to adjust this machine program.

Other features which are considered as characteristic for the invention are set forth in the appended claims.

Although the invention is illustrated and described herein as embodied in a holding frame for the package frame of a heavy winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 8:
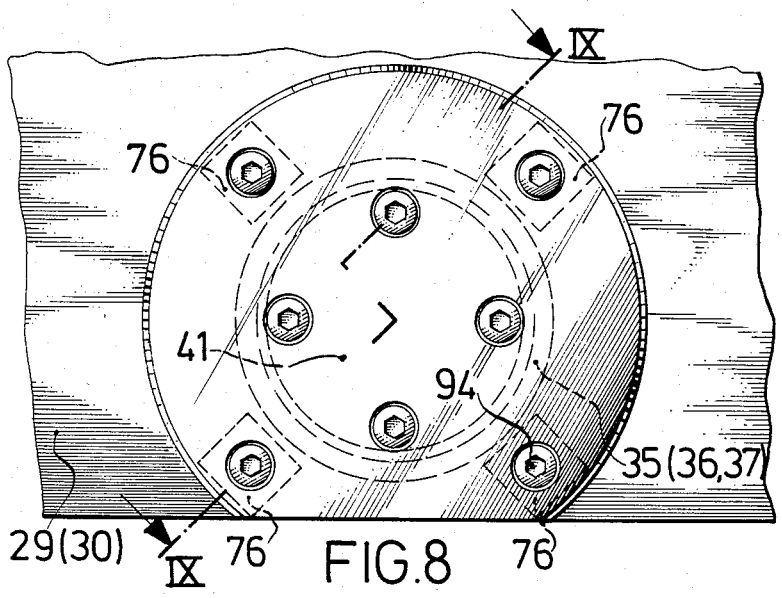
FIGS. 8 and 9 are respective fragmentary elevational and cross-sectional views of the power transfer apparatus of a carrier.
Figure 9:
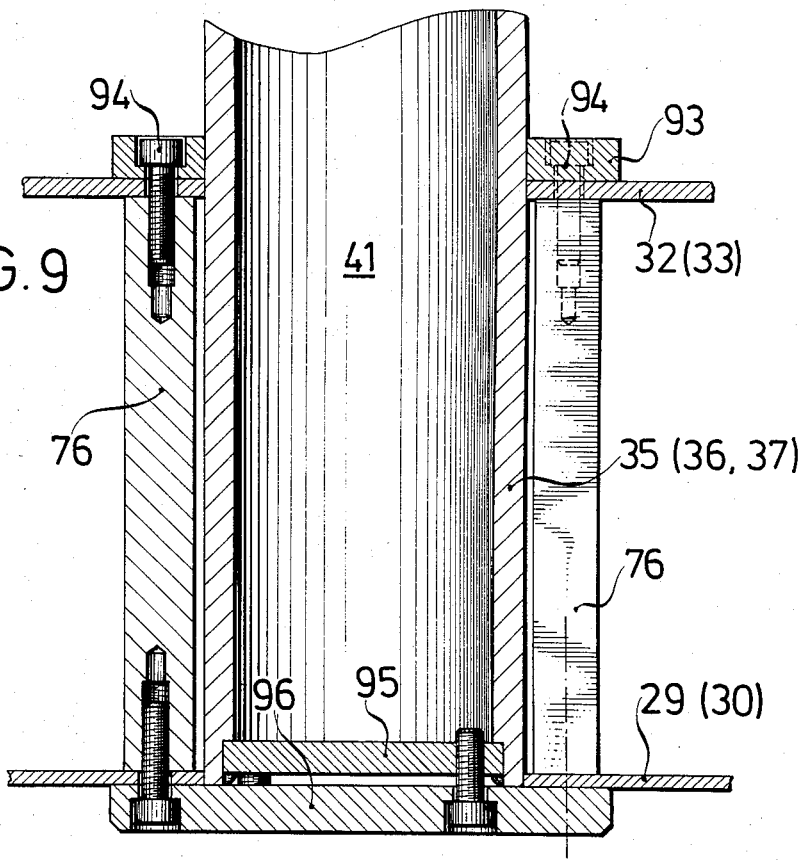

FIGS. 10 and 11 are views similar to FIGS. 8 and 9 of another force transfer apparatus of a carrier; and FIGS. 12 and 13 are other views similar to FIGS. 8 and 9 of a further variation of a force transfer device of a carrier.

Figure 1:
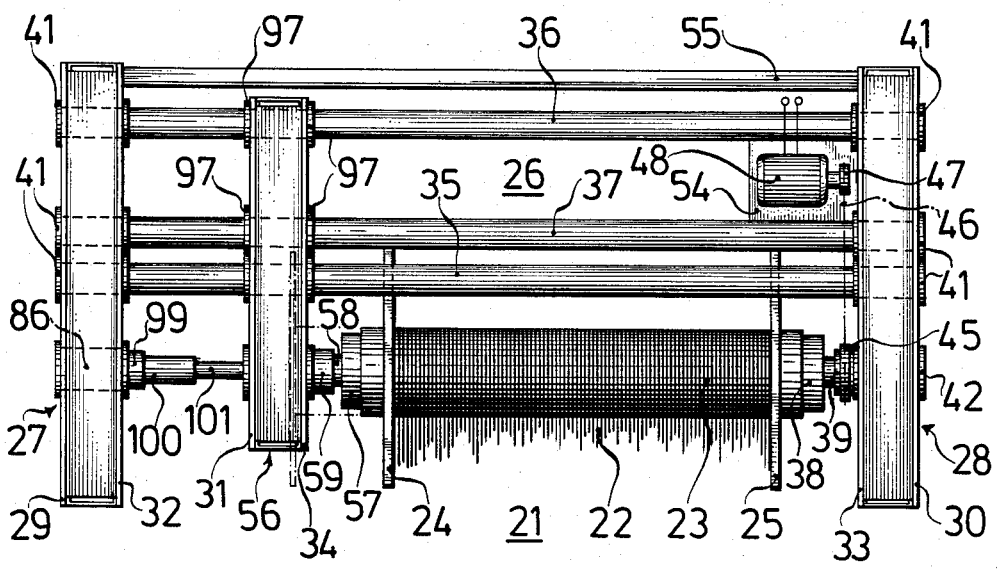
FIG. 1 is a diagrammatic top plan view of the holding frame according to the invention.

Referring now to the figures of the drawing in detail, and first particularly to FIG. 1 thereof, it is seen that the beam warping machine shown diagrammatically therein, is as a whole designated with reference numeral 21. Beam warping machines relate as a rule to an especially heavy winding machine for a group of threads 22 which are wound on a winding or spooling frame 23 in preparation for the weaving operation. The winding frame 23 has side flanges 24 and 25 which hold the finished package together, and which permit rolling of a finished wound frame on a flat surface.

The holding stand for the winding frame 23 is designated as a whole with reference numeral 26, and comprises, for other parts, a left side frame 27 and a right side frame 28 as seen from the servicing side.

Figure 3:
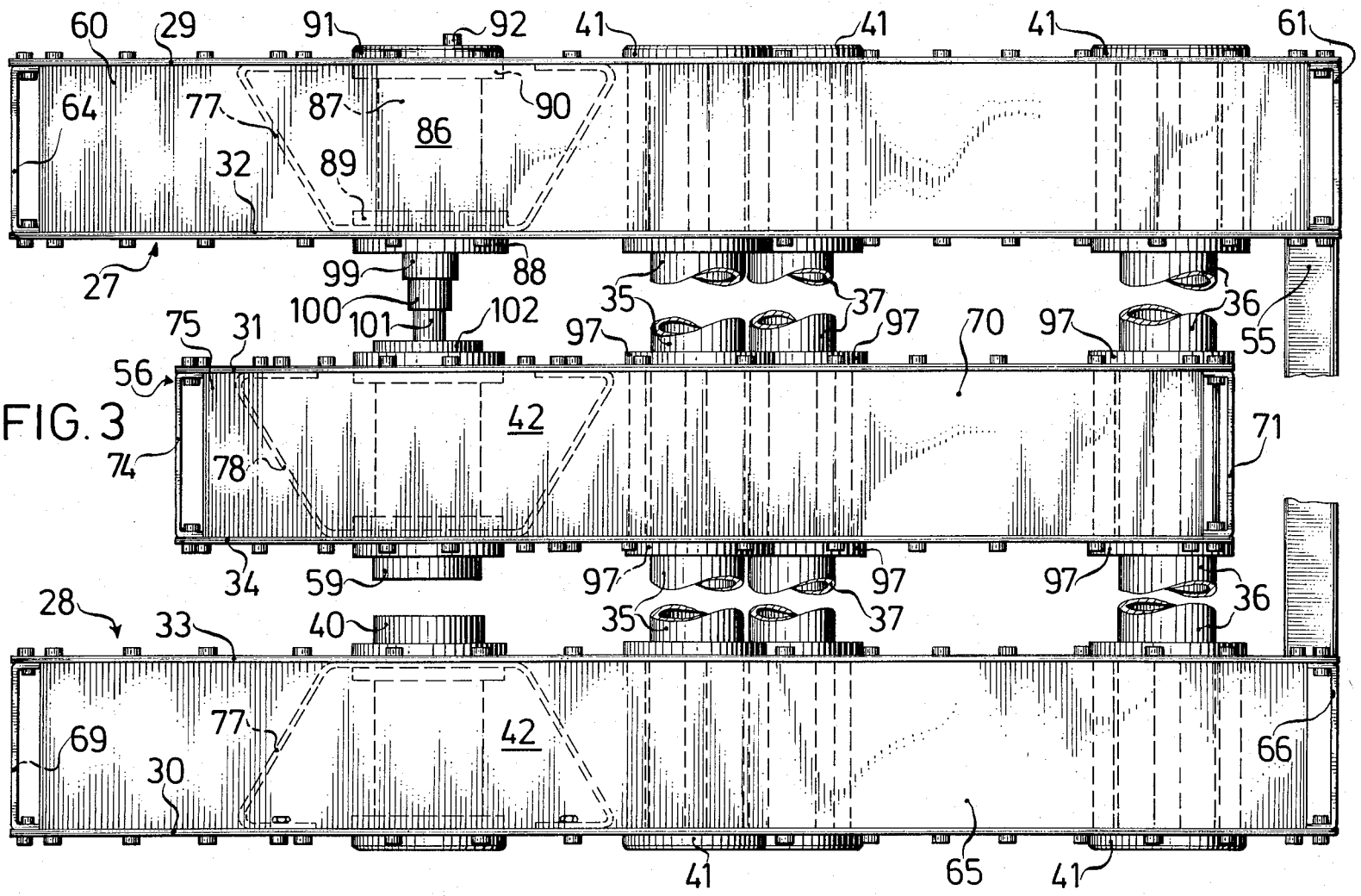
FIG. 3 is a fragmentary top plan view of the holding frame according to the invention.

FIG. 3 shows in particular that each of the two side frames is formed of two flat steel plates. For example, the side frame 27 is formed of an outer steel plate 29 and an inner steel plate 32. In a similar manner, the right side frame 28 is formed of an outer steel plate 30 and an inner steel plate 33. The side frames are rigidly connected with each other, as will be explained further on.

Figure 2:
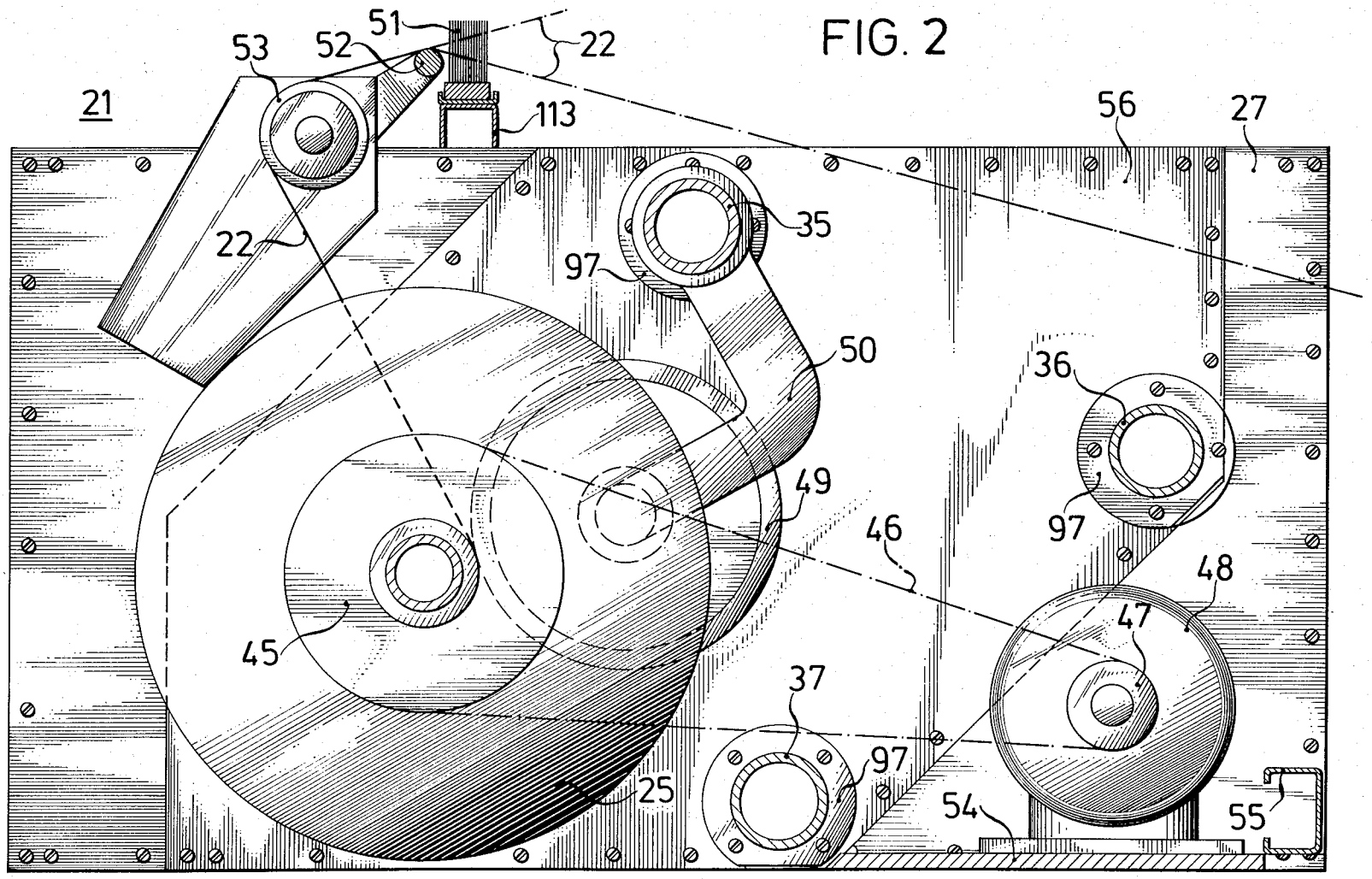
FIG. 2 is a cross-sectional view through the winding machine, showing other parts of the winding machine.

The two steel plates of each side frame are bolted together with the interposition of tension and compression resisting spacer-members. These spacers will also discussed later on. Furthermore, the two side frames 27, 28 are connected with each other by steel carrier members in the form of steel tubes 35, 36 and 37, which extend through both steel plates 29, 32 and 30, 33, respectively. FIG. 2 shows a section through the steel carrier. The right side frame 28 carries a device 38 for holding the winding frame. This frame-holding device 38 is essentially formed of a bearing 39 which is supported on a carrier tube 40. The carrier tube 40 is shown in FIG. 3 and in detail in FIG. 7. This carrier tube also extends through both steel plates 30 and 33.

At the connections between the steel plates and the steel carriers or tubes 35, 36 and 37, detachable power transfer members 41 are provided. The members 41 are especially clearly shown in FIGS. 8 and 9. At the connection between the steel plates and the carrier tube 40, a detachable power transfer member 42 is provided, and is shown in detail in FIG. 7.

FIG. 1 shows that the winding frame holding device 38 has a sprocket or chain wheel 45 which is connected by an endless chain 46 with a sprocket 47, which sits on the shaft of a drive motor 48. These parts are also indicated in FIG. 2, wherein the three steel tubes 35, 36 and 37 are cut adjacent the steel plate 33, so that other important parts of the warping machine 21 are visible. FIG. 2 shows that the beginning winding is under pressure from a contact-roller 49. The contact-roller 49 is suspended on a double arm 50 which, in turn, is swingably supported on the steel tube 35. As shown in FIG. 2, the group of threads 22 arrives in a broad fan, is conducted through a comb 51, guided over a bar 52 and finally guided around a rotatable deflection roller 53 onto the winding frame. The drive motor 48 is fastened onto a base plate 54, which is in connection with a carrier 55. This carrier 55 runs from the left side frame to the right side frame, but does not directly serve for stiffening the holding stand 26.

It can be learned, especially from FIG. 1 and FIG. 3, that there is an intermediate frame 56 slideably supported on the steel carriers and on the steel tubes 35, 36 and 37, respectively. The intermediate frame 56 is formed of two flat steel plates, which are bolted to each other with the interposition of tension and compression-resisting spacer members. In FIG. 3, an outer steel plate 31 and an inner steel plate 34 can be recognized, as seen in the direction toward the winding frame. The intermediate frame 56, according to FIG. 1, is also provided with a frame holding device 57 with a bearing 58, which is carried by a carrier tube 59 as shown in FIG. 3. In this frame holding device, the carrier tube 59 also extends through both steel plates 31 and 34.

Figure 4:
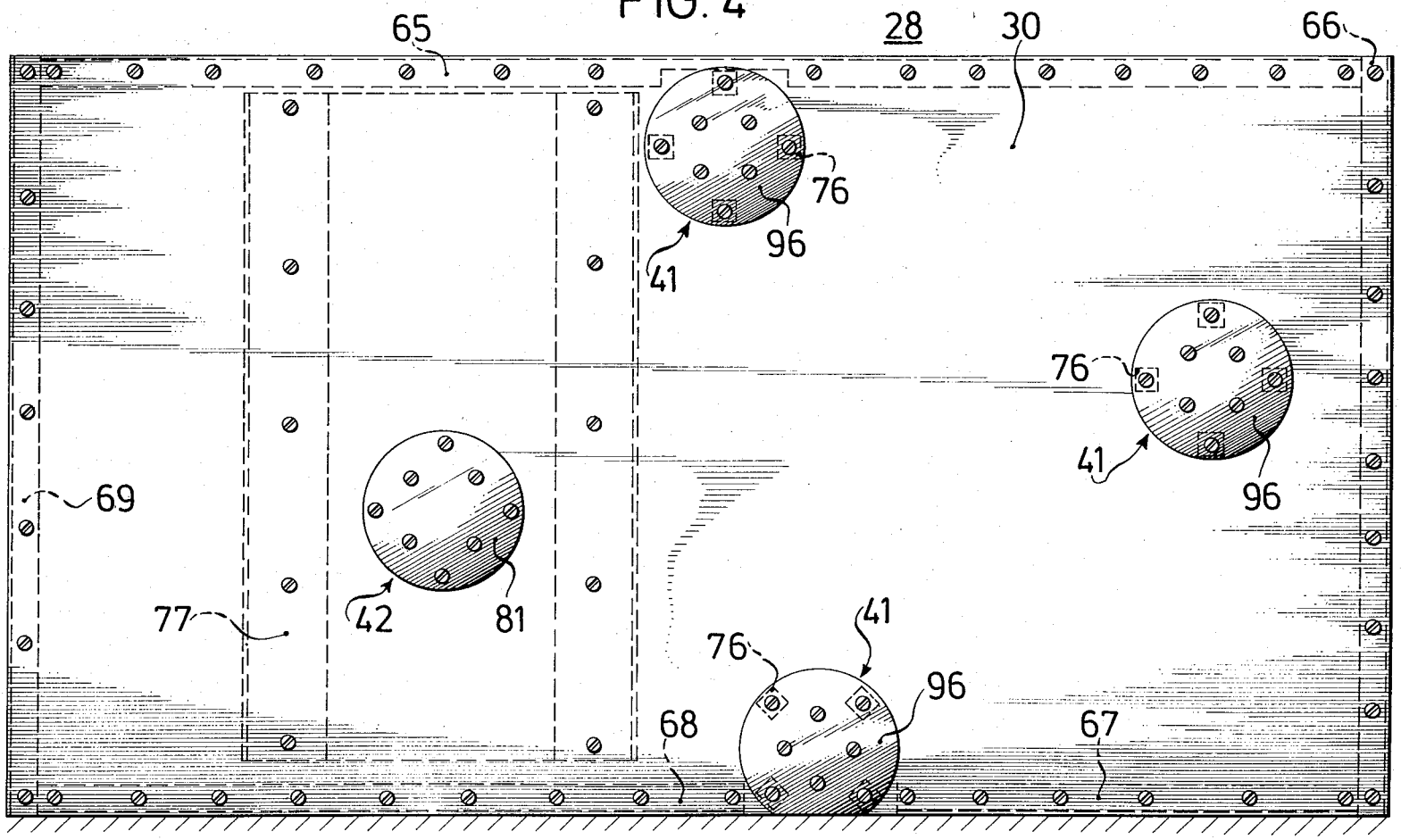
FIG. 4 is a side elevational view of the right side frame.
Figure 5:
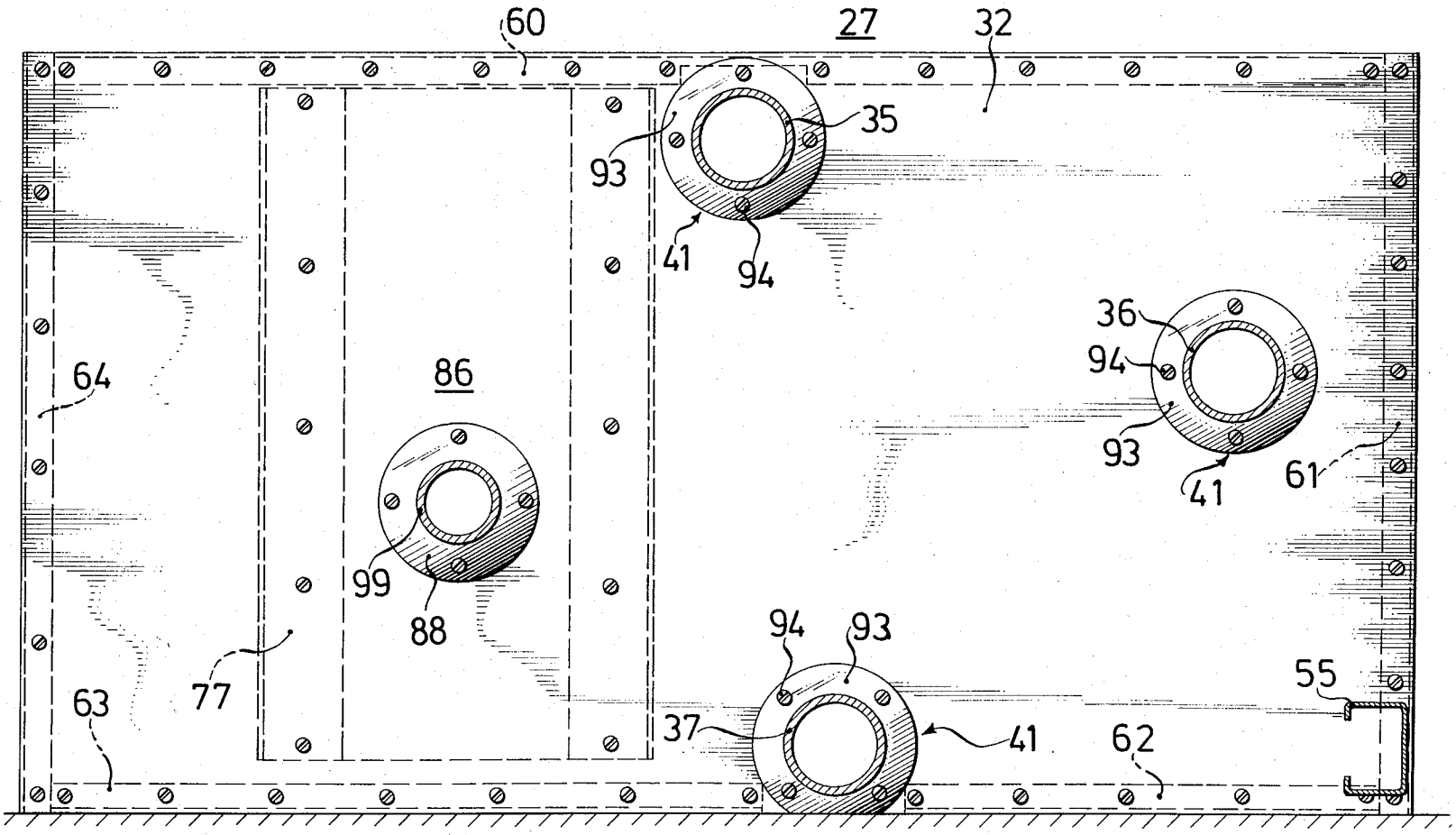
FIG. 5 is a side elevational view of the left side frames seen from the machine side.

The spacer members used in the side frames and in the intermediate frame are formed of bolts, tubes and chamfered steel pieces. For example, the spacers disposed at the edges of the steel plates 29 to 34 are right-angle (chamfered) steel pieces. At the left side frame 27, referring to FIG. 5, these spacer-members are given reference numerals 60, 61, 62, 63 and 64. At the right side frame 28, referring to FIG. 4, these spacers are given reference numerals 65 to 69 and at the intermediate frame 56 they are labelled with numerals 70 to 75, referring to FIG. 6. In the vicinity of the steel carriers 35 to 37, the spacers are bolts. These bolts all have a prismatic form, and have equal dimensions. At the perforation for each steel carrier, four spaces are provided. The spacers belong to the detachable force transfer members 41, and are designated with reference numeral 76, as shown in FIG. 4. Additionally, spacer members of a different type are also provided, are made of structural steel, and form trapezoidal reinforcements 77 and 78, as seen in FIG. 3. In another typical example according to FIGS. 10 and 11, a tubular spacer 79 is also provided.

Figure 7:
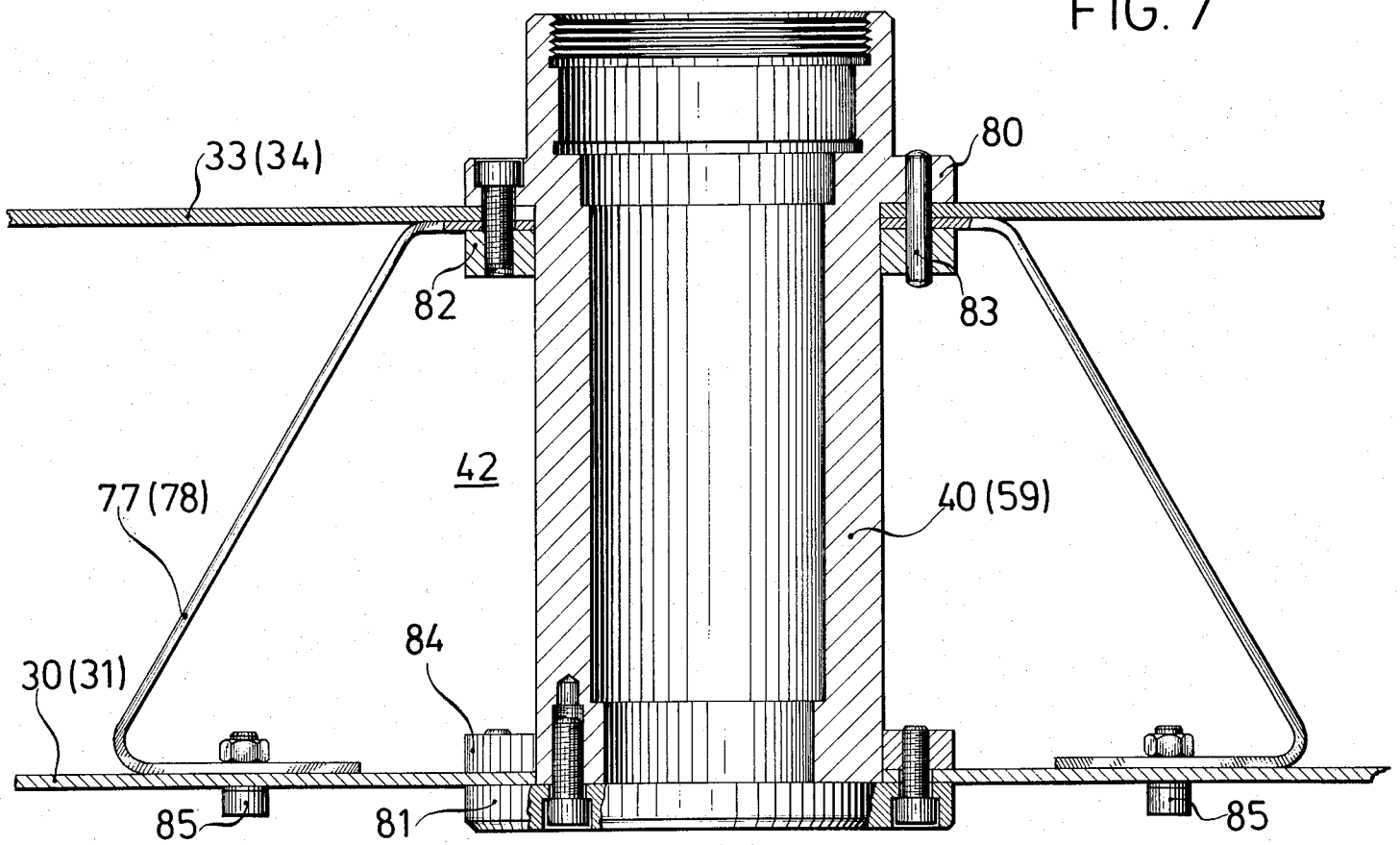
FIG. 7 is an enlarged fragmentary view of a power transfer device of the beam holding or support apparatus.

It has been previously mentioned that detachable force transfer members are provided at the connecting regions between the steel plates and the carrier tubes. FIG. 3 shows that a detachable force-transfer member 42 is provided between the steel plates 30 and 33 of the right side frame 28 and the carrier tube 40. A similar force transfer member is also provided between the steel plates 31 and 34 of the intermediate frame 56 and the carrier tube 59. FIG. 7 shows the details of this force transfer member or device. The carrier tube 40, 59 respectively, has a flange 80, which lies against the inner steel plate 33, 34, respectively. The end of the carrier tube 40, 59, respectively, is bolted to a cover 81 at the outer steel plate 30, 31, respectively, from the outside. A counter ring 82 which sits on the carrier tube 40, 59, is connected with screws to the inner steel plate 33, 34, respectively, and to the flange 80, and is additionally pinned by dowel 83. An additional counter-ring 84 sitting on the carrier tube 40, 59, is screwed to the outer steel plate 30, 31, respectively, and to the cover 81. The hereinafore-mentioned additional trapezoidal reinforcement 77, 78, respectively, is disposed between the steel plates at the location where the carrier tube 40, 59 perforates the two steel plates. The additional trapezoidal reinforcement 77, 78, respectively, is formed of structural steel, and is bolted at one side thereof to the flange 80, the counter ring 82 and the steel plate 33, 34, and at the other side is screwed with bolts 85 to the steel plate 30, 31, respectively.

The whole force transfer apparatus 42 is constructed in such a way that a good force transfer, as well as an efficient stiffening of the steel plates, is achieved.

A longitudinally adjustable pressure and holding device 86, shown in FIGS. 1 and 3, for the intermediate frame 56 and the winding frame 23, is disposed between the left side frame 27 and the intermediate frame 56 at the height of the winding frame or beam holding device 57. According to FIG. 3, the pressure and holding device 86 is formed of a stable compression-resistant pneumatic cylinder 87 with a flange 88, two counter rings 89, 90 and a cover 91 having an air line connection 92. The pneumatic cylinder 87 has the same outer diameter as the above-mentioned carrying tubes 40 and 59, so that in this case a force transfer arrangement is also effected which is equivalent to the force transfer member 42, and which is in the same way reinforced by a trapezoidal reinforcement 77 made of chamfered or structural steel.

All three steel supports or steel tubes 35, 36 and 37, respectively, have the same dimensions. Therefore, their force transfer apparatus are also constructed in the same way according to FIG. 9. The steel carrier or steel support 35, 36, or 37 has a flange 93, which lies against the inner steel plate 32, 33, respectively, and which is bolted to the inner steel plate 32, 33, as well as to bolt-like spacers 76 which extend to the steel plate, through the use of screws 94. The end of the steel carrier is closed by a plate 95 which is welded in position. By means of this plate 95, the end of the steel carrier is bolted to a cover 96, which lies on the outer steel plate 29, 30, from the outside and is bolted to the outer steel plate 29, 30 and also to the spacers 76. The flange 93 is fitted to the steel carrier as tightly as possible so that no noticeable play can occur.

Figure 6:
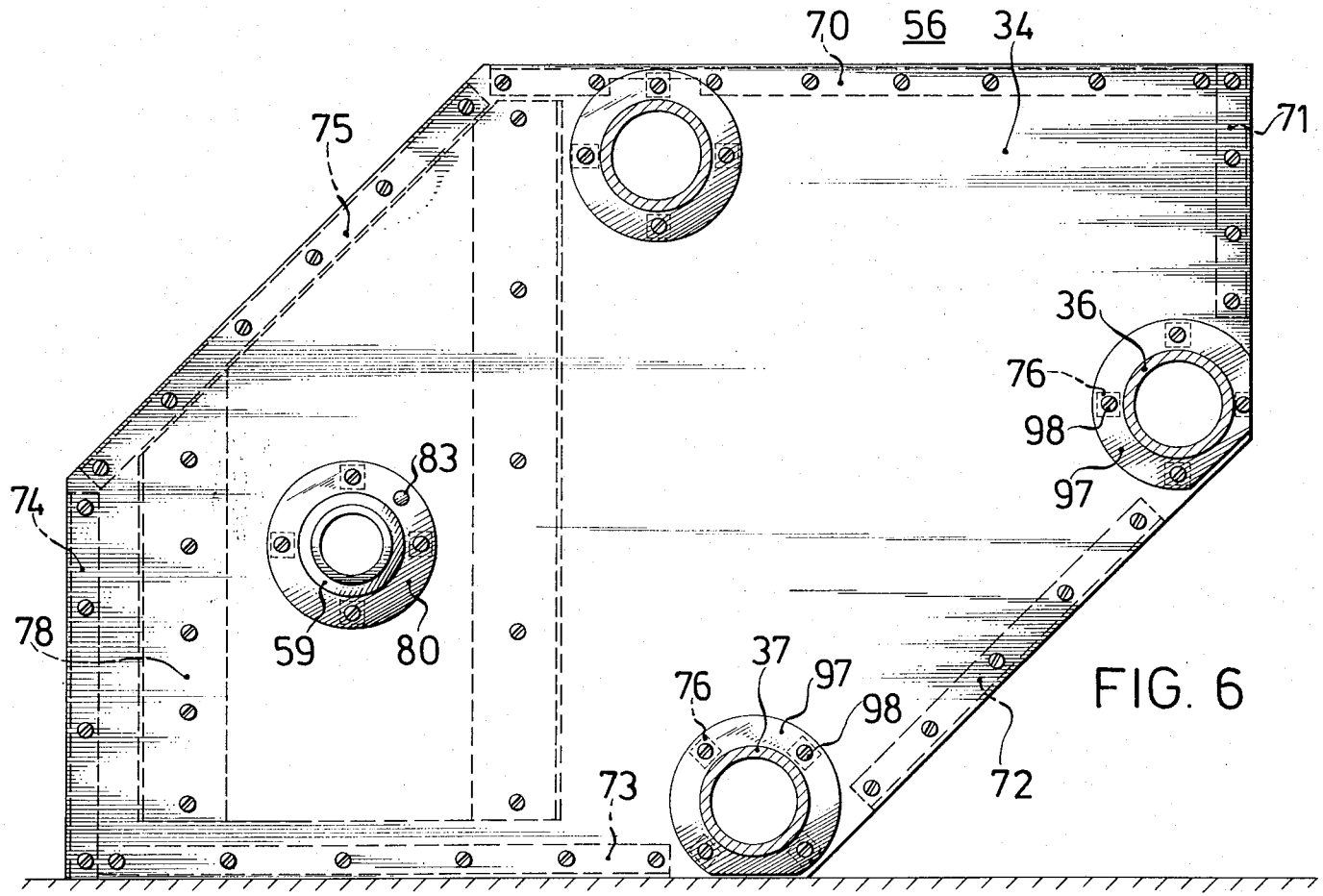
FIG. 6 is a side elevational view of an intermediate stand or frame.

The intermediate frame 56 has a bearing sleeve for each steel carrier 35, 36, 37 at each steel plate 31, 34. Since all of the bearing sleeves are rings made of a non-ferrous metal, they are uniformly designated with reference numeral 97. FIG. 6 shows that fastening screw 98 of the bearings 97 also carry bolt-like spacer-members 76, so that the mounting regions of the bearings also serve to stiffen and space the steel plates 31 and 34.

The intermediate frame 56 can be moved on the steel carriers 35, 36 and 37 by means of the pressure and holding device 86. This is effected by retractable telescoping tubes 99, 100, 101. The telescope tube 101 carries a pressure plate 102 seen in FIG. 3. The intermediate frame 56 serves two purposes. It serves to accommodate winding frames having different lengths, and it also serves to engage or lock the winding frame holding device 38, so that the winding frame 23 can be driven by the drive motor 48.

It is clearly shown that the journals of the deflection roller 53 of a support carrier 113 of the comb 51 and other parts can be very easily connected by screws to the side frames. The type and number of all screw connections is left up to the manufacturer. The choice should be governed by considerations of economy, and static and dynamic principles.

Finally, two alternative force transfer apparatus will be discussed. One force transfer apparatus is designated with reference numeral 43, and is illustrated in FIGS. 10 and 11. The other force transfer apparatus is designated with reference numeral 44, and is shown in FIGS. 12 and 13. Both force transfer apparatus serve to transfer forces from one steel carrier, for example the steel carrier 35, to the steel plates of a side frame, such as to the steel plates 30 and 33 of the right side frame 28. At the first mentioned force transfer apparatus 43, the steel carrier 35 has a flange 104, which lies against the inner steel plate 33, and is also bolted to the inner steel plate 33, as well as to a tubular spacer 79 which extends from steel plate to steel plate. Similar to the force transfer apparatus 41, in the force transfer apparatus 43, the end of the steel carrier 35 is closed by a plate 95 which is welded in place. In this case as well, the plate 95, and therefore the steel carrier 35, are bolted to a cover 96, which also lies against the outer steel plate 30 from the outside, and is also bolted to the outer steel plate 30 and the spacer 79. The spacer 79 is form-lockingly connected to the steel carrier 35 by a dowel pin 105. A form-locking connection is one in which parts are locked together due to their particular shapes. The pin 105 not only serves the purpose of preventing rotation, but also serves for receiving and transmitting forces. Several pins may also be used or a pin can be used which passes through. The dowel pin 105 is only installed during the final assembly. It must be removed from the inside if the machine is taken apart. The force transfer apparatus 43 is more stable than the force transfer apparatus 41 due to the form-locking connection of the steel carrier 35 with the spacer 79, and due to the tubular form of the spacer 79.

The force transfer apparatus 44 has a flange 106, which is constructed as a pressure ring mounted on the steel carrier 35, and which applies radial forces onto the steel carrier 35 in the bolted condition. For this purpose, the flange 106 is made of an elastically deformable steel. At the four fastening points of the flange 106, bridge-like raised portions 107 are provided. These raised portions 107 are provided to avoid contact with the steel plate 33 at these locations. Each of the bridge-like raised portions 107 is provided with a conical recess 108 for receiving screws 110 which also have conical contact surfaces. When the four screws 110 are tightened, the flange 106 centers itself. Additionally, the flange 106 is pressed against the steel plate 33. Furthermore, the flange 106 acts as a pressure ring with a radial force directed against the steel carrier 35. The screws 110 connect the flange 106 and the steel plate 33 with four similar bolt-shaped spacing members 76.

In this case too, a plate 95 is welded in place at the end of the steel carrier 35 and has a cover 112 which is bolted with screws 111. The cover 112 is also formed of an elastically deformable steel and is produced by bending dies. The cover is provided with a circular shoulder 113, which lies against the steel carrier 35 from the inside. In this way, the shoulder serves as centering means.

The cover 112 also has bridge-like raised portions 114 at the fastening points with conical recesses 109 for the screws 110, which are also provided with conical contact surfaces. In this construction the cover 114 is self-centering when the screws 110 are tightened.

Because of the fact that the flange 106 can directly receive and transmit radial forces from the steel carrier 35, and because of the self-centering action of the flange 106 and the cover 112 by the screws, the force transfer apparatus 44 seems to also be more stable than the force transfer apparatus 41. Furthermore, the manufacture of the flange and the cover has some advantages production-wise.

The invention is not restricted to the illustrated and described typical embodiments. For example, the triangular configuration of the steel carrier has proven itself advantageous. However, other configurations are also possible. The rectangular form of the side frames is simple to manufacture. However, for example, the upper corners could be bevelled to facilitate the operation of the machine. The placement of the spacers 60 to 75 with their even rear sides facing outward serves not only for a more pleasing appearance, but also prevents accidents. In this case, there are less sharp edges on the frames. A decision must be made in each case if, in addition to the hereinafore-described spacers and reinforcement members or stiffeners, added parts of this type are necessary for stability reasons. The total cost of the holding stand is only insignificantly increased by such additions.

I claim:

1. Holding frame for a package beam of a heavy winding machine, comprising a right side frame and a left side frame, each of said side frames being formed of a pair of flat sheet steel plates, tension resistant and compression resistant spacer members being interposed between each pair of plates, each pair of plates being bolted together with said spacer members therebetween, first carriers formed of steel penetrating said plates at connection locations and rigidly connecting said side frames to each other, a beam receiving device disposed at least at one of said side frames, a second carrier with a tubular shape penetrating said pair of plates of said at least one side frame at connection locations and supporting said beam receiving device, and detachable force transmission devices being disposed between said plates and at least one of said carriers at least at one of said connection locations.

2. Holding frame according to claim 1, including an intermediate frame being slideably supported on said first steel carriers, said intermediate frame being formed of a pair of flat sheet steel plates, other tension proof and compression resistant spacer members being interposed between said pair of plates of said intermediate frame, said plates of said intermediate frame being bolted together with said spacer members disposed therebetween, another beam receiving device disposed at said intermediate frame, and a third tubular carrier penetrating said plates of said intermediate frame and supporting said other beam receiving device.

3. Holding frame according to claim 2, wherein said first steel carriers are steel tubes, and said first steel carrier tubes penetrate said plates of said intermediate frame at holes formed in said plates.

4. Holding frame according to claim 2, wherein said spacer members are bolts.

5. Holding frame according to claim 2, wherein said spacer members are tubes.

6. Holding frame according to claim 2, wherein said spacer members are bevelled steel members.

7. Holding frame according to claim 2, wherein each pair of plates is formed of an outer end and an inner plate, and said third tubular carrier has a flange integral therewith being disposed at said inner plate and has an end opposite said flange, and including a cover being disposed at said outer plate and being bolted to said end of said carrier, and a counter ring being mounted on said third tubular carrier and bolted to said outer plate and to said cover.

8. Holding frame according to claim 7, including an additional reinforcement disposed between said plates where said carrier tube penetrates said plates at the level of said pressure and holding device.

9. Holding frame according to claim 2, wherein said intermediate frame includes a bearing at each plate thereof for at least two of said first steel carriers.

10. Holding frame according to claim 2, including a longitudinally adjustable pressure and holding device for said intermediate frame and the package beam, being disposed between said left and right side frames and said intermediate frame, at the level of said beam receiving device.

11. Holding frame according to claim 10, including an additional reinforcement disposed between said plates where said carrier tube penetrates said plates at the level of said pressure and holding device.

12. Holding fram according to claim 1, wherein said spacer members are bolts.

13. Holding frame according to claim 1, wherein said spacer members are tubes.

14. Holding frame according to claim 1, wherein said spacer members are bevelled steel members.

15. Holding frame according to claim 1, wherein each pair of plates is formed of an outer and an inner plate, and said second tubular carrier has a flange integral therewith being disposed at said inner plate and has an end opposite said flange, and including a cover being disposed at said outer plate and being bolted to said end of said carrier, and a counter ring being mounted on said second tubular carrier and bolted to said outer plate and to said cover.

16. Holding frame according to claim 15, including an additional reinforcement disposed between said plates where said carrier tube penetrates said plates at the level of said pressure and holding device.

17. Holding frame according to claim 1, wherein each pair of plates is formed of an outer and an inner plate, said first steel carriers have flanges integral therewith being disposed against said inner plates and being bolted to said inner plates and bolted to at least one of said spacer members being disposed between said plates, and said first steel carriers have ends opposite said flanges, and including covers being sidposed at said outer plates and being bolted to said ends of said carriers, to said outer plates and to said spacer members.

18. Holding frame according to claim 17, wherein said flanges are pressure rings being mounted on said first steel carriers transmitting radial forces to said first steel carriers when bolted on.

19. Holding frame according to claim 17, wherein said flanges and covers have fastening locations, and including bridge-like raised portions disposed at least at one of said fastening locations, said raised portions having recesses formed therein for fasteners with contact surfaces matching said recesses.

20. Holding frame according to claim 18, wherein said flanges and covers have fastening locations, and including bridge-like raised portions disposed at least at one of said fastening locations, said raised portions having recesses formed therein for fasteners with contact surfaces matching said recesses.

* * * * *